US006087999A

United States Patent [19]

Muhlhauser et al.

[11] Patent Number: 6,087,999

[45] Date of Patent: Jul. 11, 2000

[54] REFLECTOR BASED DIELECTRIC LENS ANTENNA SYSTEM

[75] Inventors: Nicholas L. Muhlhauser; Kenneth P. Cannizzaro, both of Los Gatos; Brian C. Hewett, Los Altos Hills, all of Calif.

[73] Assignee: **E*Star, Inc.**, Los Gatos, Calif.

[21] Appl. No.: 09/004,759

[22] Filed: Jan. 8, 1998

Related U.S. Application Data

[63] Continuation-in-part of application No. 08/519,282, Aug. 25, 1995, Pat. No. 5,831,582, which is a continuation-in-part of application No. 08/299,376, Sep. 1, 1994, Pat. No. 5,495,258.

[51] Int. Cl.[7] ..... H01Q 19/06

[52] U.S. Cl. ..... 343/753; 343/840; 343/786

[58] Field of Search ..... 343/753, 840, 343/754, 755, 756, 786, 909, 912; H01Q 19/06

[56] References Cited

U.S. PATENT DOCUMENTS

| | | | |
|---|---|---|---|
| 2,682,610 | 6/1954 | King | 343/772 |
| 2,735,092 | 2/1956 | Brown, Jr. | 343/772 |
| 2,816,271 | 12/1957 | Barker | 343/772 |
| 2,847,672 | 8/1958 | Giffin et al. | 343/895 |
| 2,863,148 | 12/1958 | Gammon et al. | 343/895 |
| 2,934,762 | 4/1960 | Smedes | 343/754 |
| 2,953,781 | 9/1960 | Donnellan et al. | 343/895 |
| 2,977,594 | 3/1961 | Marston et al. | 343/895 |
| 2,982,959 | 5/1961 | Hanneken | 343/724 |
| 3,017,633 | 1/1962 | Marston et al. | 343/895 |
| 3,135,960 | 6/1964 | Kaiser, Jr. | 343/895 |
| 3,170,158 | 2/1965 | Rotman | 343/753 |
| 3,267,472 | 8/1966 | Fink | 343/753 |
| 3,369,197 | 2/1968 | Giger et al. | 343/772 |
| 3,509,572 | 4/1970 | Barbano | 343/792.5 |
| 3,623,118 | 11/1971 | Monser | 343/863 |

(List continued on next page.)

FOREIGN PATENT DOCUMENTS

| | | |
|---|---|---|
| 0682383 | 11/1995 | European Pat. Off. . |
| 0553707 | 5/1996 | European Pat. Off. . |
| 0141602 | 11/1981 | Japan . |
| 0187003 | 11/1983 | Japan . |

OTHER PUBLICATIONS

PCT, WO 94/16472, Jul. 1994.

PCT, WO 92/07394, Apr. 1992.

"Array Antenna Composed of 4 Short Axial–Mode Helical Antennas" by Takayasu Shiokawa and Yoshio Karasawa.

"A Study of the Sheath Helix with a Conducting Core and its Application to the Helical Antenna" by Neureuther, Klock and Mittra.

"Wave Propagation on Helices" IEEE Transactions on Antennas and Propagation.

"Array of Helices Coupled a Waveguide" by Nakano, et. al.

"Broadband Quasi–Taper Helical Antennas" by Wong, et. al., IEEE 1979.

"Grating Lobe Control in Limited Scan Arrays" by Mailloux, et. al., IEEE, 1979.

"Short Helical Antenna Array Fed from a Waveguide" by Nakano, et. al., IEEE, 1984.

"Radiation from a Sheath Helix Excited by a Waveguide: a Wiener–Hopf analysis" by Fernandes, et. al., IEEE Proceedings,Oct. 1990.

(List continued on next page.)

*Primary Examiner*—Hoanganh Le
*Attorney, Agent, or Firm*—Joseph A. Rhoa

[57] ABSTRACT

A multiple beam antenna system including a reflector that is at least partially parabolic in one dimension, a pair of dielectric lenses, and a pair of waveguides. Multiple received beams are received and reflected by the reflector into an orthogonal mode junction which separates signals of a first polarity from signals of a second orthogonal polarity. The signals of the first polarity are forwarded into a first waveguide and the orthogonal signals of the second polarity are forwarded into a second parallel waveguide. A plurality of satellites may be accessed simultaneously thus allowing the user to utilize both signals at the same time.

16 Claims, 12 Drawing Sheets

U.S. PATENT DOCUMENTS

| | | | |
|---|---|---|---|
| 3,718,932 | 2/1973 | Ikrath et al. | 343/728 |
| 3,852,762 | 12/1974 | Henf et al. | 343/756 |
| 3,864,688 | 2/1975 | Hansen et al. | 343/756 |
| 3,931,624 | 1/1976 | Hundley et al. | 343/840 |
| 4,123,759 | 10/1978 | Hines et al. | 343/854 |
| 4,315,266 | 2/1982 | Ellis, Jr. | 343/895 |
| 4,400,703 | 8/1983 | Shiokawa et al. | 343/895 |
| 4,427,984 | 1/1984 | Anderson | 343/895 |
| 4,467,294 | 8/1984 | Janky et al. | 333/126 |
| 4,467,329 | 8/1984 | Thal, Jr. | 343/753 |
| 4,494,117 | 1/1985 | Coleman | 343/895 |
| 4,511,868 | 4/1985 | Munson et al. | 333/257 |
| 4,584,588 | 4/1986 | Mohring et al. | 343/786 |
| 4,647,938 | 3/1987 | Roederer et al. | 343/756 |
| 4,660,050 | 4/1987 | Phillips | 343/753 |
| 4,680,591 | 7/1987 | Axford et al. | 343/895 |
| 4,785,302 | 11/1988 | Ma et al. | 342/362 |
| 4,791,428 | 12/1988 | Anderson | 343/758 |
| 4,845,507 | 7/1989 | Archer et al. | 343/754 |
| 4,920,351 | 4/1990 | Bartlett et al. | 343/756 |
| 5,041,842 | 8/1991 | Blaese | 343/895 |
| 5,053,786 | 10/1991 | Silverman et al. | 343/895 |
| 5,061,943 | 10/1991 | Rammos | 343/770 |
| 5,117,240 | 5/1992 | Anderson et al. | 343/786 |
| 5,146,234 | 9/1992 | Lalezari | 343/895 |
| 5,227,807 | 7/1993 | Bohlman et al. | 343/895 |
| 5,243,358 | 9/1993 | Sanford et al. | 343/836 |
| 5,255,004 | 10/1993 | Berkowitz et al. | 343/853 |
| 5,258,771 | 11/1993 | Praba | 343/895 |
| 5,345,248 | 9/1994 | Hwang et al. | 343/895 |
| 5,359,336 | 10/1994 | Yoshida | 343/756 |
| 5,495,258 | 2/1996 | Muhlhauser et al. | 343/895 |
| 5,528,717 | 6/1996 | Schwering et al. | 385/129 |
| 5,619,173 | 4/1997 | King et al. | 343/756 |
| 5,652,597 | 7/1997 | Caille | 343/756 |
| 5,686,923 | 11/1997 | Schaller | 342/352 |

OTHER PUBLICATIONS

"Low–Profile Helical Array Antenna Fed from a Radial Waveguide" by Nakano, et. al., IEEE, 1992.

"Wave Propagation on Helical Antennas" by Cha, IEEE, vol. AP–20, No. 5, Sep. 1972.

"Review of Radio Frequency Beamforming Techniques for Scanned and Multiple Beam Antennas" by Hall, et. al., IEEE, vol. 137, PT.H No. 5, Oct., 1990.

"Design Trades for Rotman Lenses" by Hansen, IEEE, 1991.

"Design of Compact Low–Loss Rotman Lenses" by Rogers, IEEE, vol. 134, Pt.H, No. 5, Oct., 1987.

"Focusing Characteristics of Symmetrically Configured Bootlace Lenses" by Shelton, IEEE, vol. AP–26, No. 4, Jul., 1978.

"A Microstrip Multiple Beam Forming Lens" by Fong, et. al.

"Design Considerations for Ruze and Rotman Lenses" by Smith, The Radio and Electronic Engineer, vol. 52, No. 4, pp. 181–187,Apr. 1982.

"Amplitude Performance of Ruze and Rotman Lenses" by Smith, et. al. Radio and Electronic Engineer, vol. 53, No. 9, Sep., 1983.

"Microstrip Port Design and Sidewall Absorption for Printed Rotman Lenses" by Musa, IEEE, vol. 136, Pt.H, No. 1, Feb. 1989.

"Wide–Angle Microwave Lens for Line Source Applications" by Rotman, et. al., IEEE, Nov.

"Short Helical Antenna Array Fed from a Waveguide" by Nakano, et. al., IEEE, 1983.

SECTION AA

REFLECTOR BASED DIELECTRIC LENS ANTENNA SYSTEM

This application is a continuation-in-part (CIP) of U.S. Ser. No. 08/519,282, filed Aug. 25, 1995, which is now U.S. Pat. No. 5,831,582, which is a continuation-in-part (CIP) of U.S. Ser. No. 08/299,376, filed Sep. 1, 1994, which is now U.S. Pat. No. 5,495,258, the disclosures of which are hereby incorporated herein by reference.

This invention relates to a multiple beam antenna system. More particularly, this invention relates to a multiple beam antenna system including a reflective member used in combination with a pair of dielectric lenses so as to form infinite arrays formed by the lens and/or orthogonal mode junction (OMJ).

BACKGROUND OF THE INVENTION

High gain antennas are widely useful for communication purposes such as radar, television receive-only (TVRO) earth station terminals, and other conventional sensing/transmitting uses. In general, high antenna gain is associated with high directivity, which in turn arises from a large radiating aperture.

U.S. Pat. No. 4,845,507 discloses a modular radio frequency array antenna system including an array antenna and a pair of steering electromagnetic lenses. The antenna system of the '507 patent utilizes a large array of antenna elements (of a single polarity) implemented as a plurality of subarrays driven with a plurality of lenses so as to maintain the overall size of the system small while increasing the overall gain of the system. Unfortunately, the array antenna system of the '507 patent cannot simultaneously receive both right-hand and left-handed circularly polarized signals (i.e. orthogonal signals), and furthermore cannot simultaneously receive signals from different satellites wherein the signals are right-handed circularly polarized, left-handed circularly polarized, linearly polarized, or any combination thereof.

U.S. Pat. No. 5,061,943 discloses a planar array antenna assembly for reception of linear signals. Unfortunately, the array of the '943 patent, while being able to receive signals in the fixed satellite service (FSS) and the broadcast satellite service (BSS) at 10.75 to 11.7 GHz and 12.5 to 12.75 GHz, respectively, cannot receive signals (without significant power loss and loss of polarization isolation) in the direct broadcast (DBS) band, as the DBS band is circular (as opposed to linear) in polarization.

U.S. Pat. No. 4,680,591 discloses an array antenna including an array of helices adapted to receive signals of a single circular polarization (i.e. either right-handed or left-handed). Unfortunately, because satellites transmit in both right and left-handed circular polarizations to facilitate isolation between channels and provide efficient bandwidth utilization, the array antenna system of the '591 patent is blind to one of the right-handed or left-handed polarizations because all elements of the array are wound in a uniform manner (i.e. the same direction).

It is apparent from the above that there exists a need in the art for a multiple beam array antenna system (e.g. of the TVRO type) which is small in size, cost effective, and able to increase gain without significantly increasing cost. There also exists a need for such a multiple beam antenna system having the ability to receive each of right-handed circularly polarized signals, left-handed circularly polarized signals, and linearly polarized signals; and/or the ability to receive each of horizontally polarized signals, vertically polarized signals, and also optionally linearly polarized signals. Additionally, the need exists for such an antenna system having the potential to simultaneously receive signals from different satellites, the different signals received being of the right-handed circularly polarized type (or horizontally polarized type), left-handed circularly polarized type (or vertically polarized signals), linearly polarized typed, or combinations thereof. It is the purpose of this invention to fulfill the above-described needs in the art, as well as other needs apparent to the skilled artisan from the following detailed description of this invention.

Those skilled in the art will appreciate the fact that array antennas and antennas herein are reciprocal transducers which exhibit similar properties in both transmission and reception modes. For example, the antenna patterns for both transmission and reception are identical and exhibit approximately the same gain. For convenience of explanation, descriptions are often made in terms of either transmission or reception of signals, with the other operation being understood. Thus, it is to be understood that the antenna systems of the different embodiments of this invention to be described below may pertain to either a transmission or reception mode of operation. Those skilled in the art will also appreciate the fact that the frequencies received/transmitted may be varied up or down in accordance with the intended application of the system. Those of skill in the art will further realize that right and left-handed circular polarization may be achieved via properly summing horizontal and vertical linearly polarized elements; and that the antenna systems herein may alternatively be used to transmit/receive horizontal and vertical signals. It is also noted that the array antenna to be described below may simultaneously receive and transmit different signals.

SUMMARY OF THE INVENTION

Generally speaking, this invention fulfills the above-described needs in the art by providing a multiple beam array antenna system for simultaneously receiving/transmitting orthogonal signals of different polarity, the system comprising:

- means for receiving/transmitting each of (i) linearly polarized signals, and (ii) at least one of horizontally and vertically polarized signals;
- means for simultaneously receiving/transmitting at least two of: (i) horizontally polarized signals; (ii) vertically polarized signals; and (iii) circularly polarized signals; and
- a parabolic reflective member communicatively associated with first and second lenses.

This invention will now be described with respect to certain embodiments thereof, accompanied by certain illustrations, wherein.

DETAILED DESCRIPTION OF CERTAIN EMBODIMENTS OF THIS INVENTION

Figure 1:
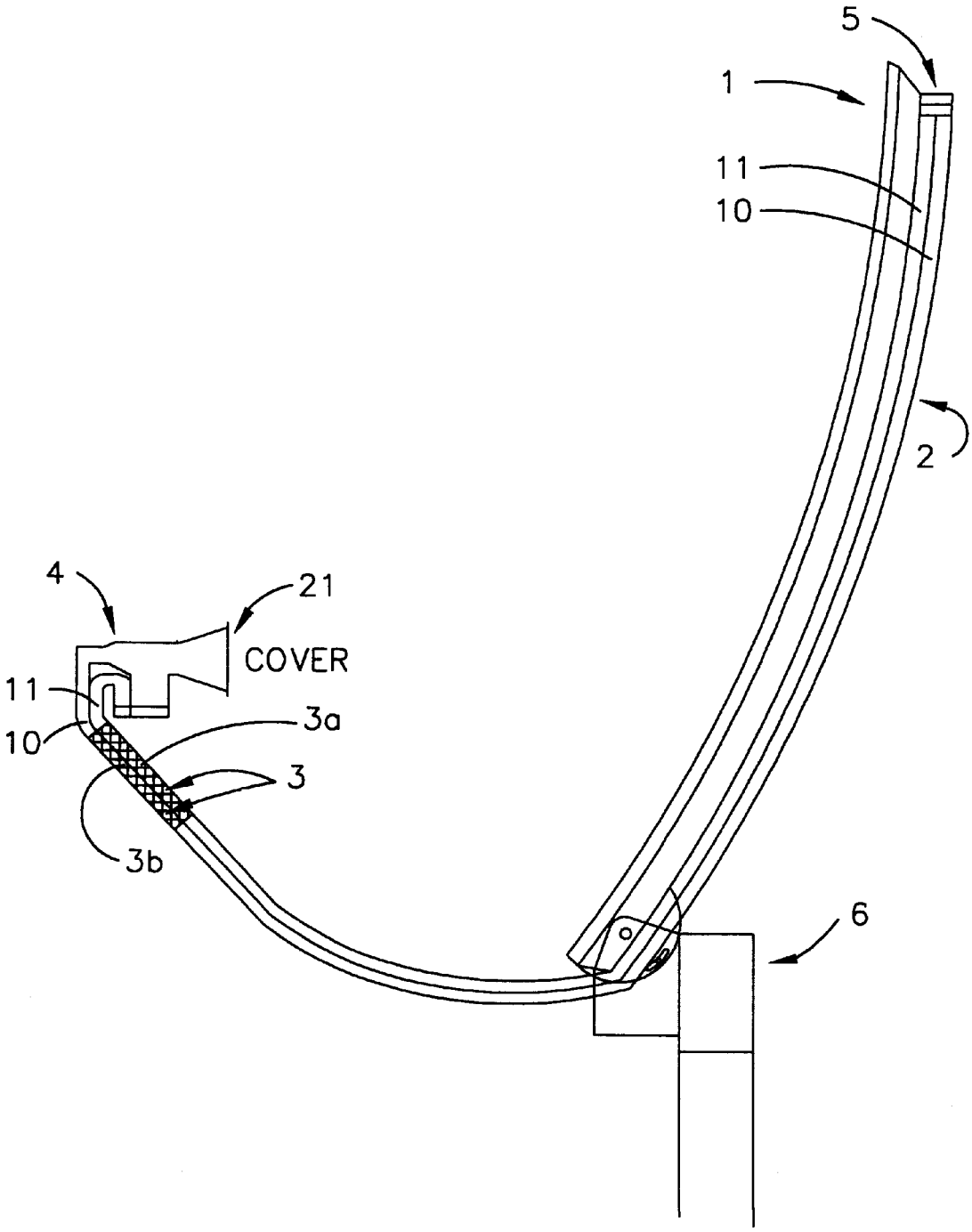
FIG. 1 is a side cross sectional view of a multiple beam antenna system according to an embodiment of this invention, the system including a reflector fed dual orthogonal dielectric lens coupled to a multiple beam port low noise block down converter (LNB).

Referring now more particularly to the accompanying drawings in which like reference numerals indicate like parts throughout the several views.

FIG. 1 is a side cross sectional view of a multiple beam antenna system according to an embodiment of this invention, the system including a reflector fed dual orthogonal dielectric lens coupled to a multiple beam port low noise block down converter (LNB).

For example, in this invention, the antenna system can receive linear components of circularly polarized signals from satellites, break them down and process them as different linear signals, and recreate them to enable a viewer to utilize the received circularly polarized signals.

The system is adapted to receive signals in about the 10.70–12.75 GHz range in this and certain other embodiments. The multiple beam antenna system of this embodiment takes advantage of a unique dielectric lens design, including a pair of dielectric lenses 3*a* and 3*b* to produce a high gain scanning system with few or no phase controls. Electromagnetic lenses 3*a* and 3*b* (described below) are provided in combination with a switching network so as to allow the selection of a single beam or group of beams as required for specific applications. The antenna system receives (or transmits) signals from multiple satellites simultaneously, these different satellites coexisting. The multiples signals received from the multiple satellites, respectively, split up as a function of orthogonal componentry and follow different waveguides for processing. For example, vertically polarized signals may be divided out and travel down one waveguide while horizontally polarized signals are divided out and travel down another waveguide. In such a manner, a user may tap into different signals from different satellites, e.g. horizontally polarized signals, vertically polarized signals, or circularly polarized signals. Further, a plurality of different satellites may be accessed simultaneously enabling a user to utilized multiple signals at the same time.

A unique feature is the combination of at least partially parabolic reflective member 1 with, or operatively associated with, dielectric lenses 3*a* and 3*b*. The combination or a beam forming network with a phase array illumination of a parabolic dish allows the antenna system to simultaneously view many satellites (e.g. up to about seven) of any polarity along their geostationary orbits. The dual lenses feed the reflective surface 1 of the dish, or vice versa. This design allows the lenses to simultaneously see or access more than one satellite signal (e.g. horizontal and vertical signals), and allows the system to scale system or antenna gain and G/t to performance requirements of the user. The dish or reflector 1 provides efficient or cheap variable gain (i.e. scaling to accommodate various satellite E.R.I.P. requirements), while the lenses provide the phase capability. The overall system may weight from only about 12–15 pounds.

The multiple beam antenna systems of the different embodiments may be used in association with, for example, DBS and TVRO applications. In such cases, an antenna system of relatively high directivity is provided and designed for a limited field of view. The system when used in at least DBS applications provides sufficient G/T to adequately demodulate digital or analog television downlink signals from high powered Ku band DBS satellites in geostationary orbit. Other frequency bands may also be transmitted/received. The field of view may be about ±32 degrees in certain embodiments, but may be greater or less in certain other embodiments.

With respect to the term "G/T" mentioned above, this is the figure of merit of an earth station receiving system and is expressed in dB/K. $G/T=G_{dBi}-10\log T$, where G is the gain of the antenna at a specified frequency and T is the receiving system effective noise temperature in degrees Kelvin.

Figure 2:
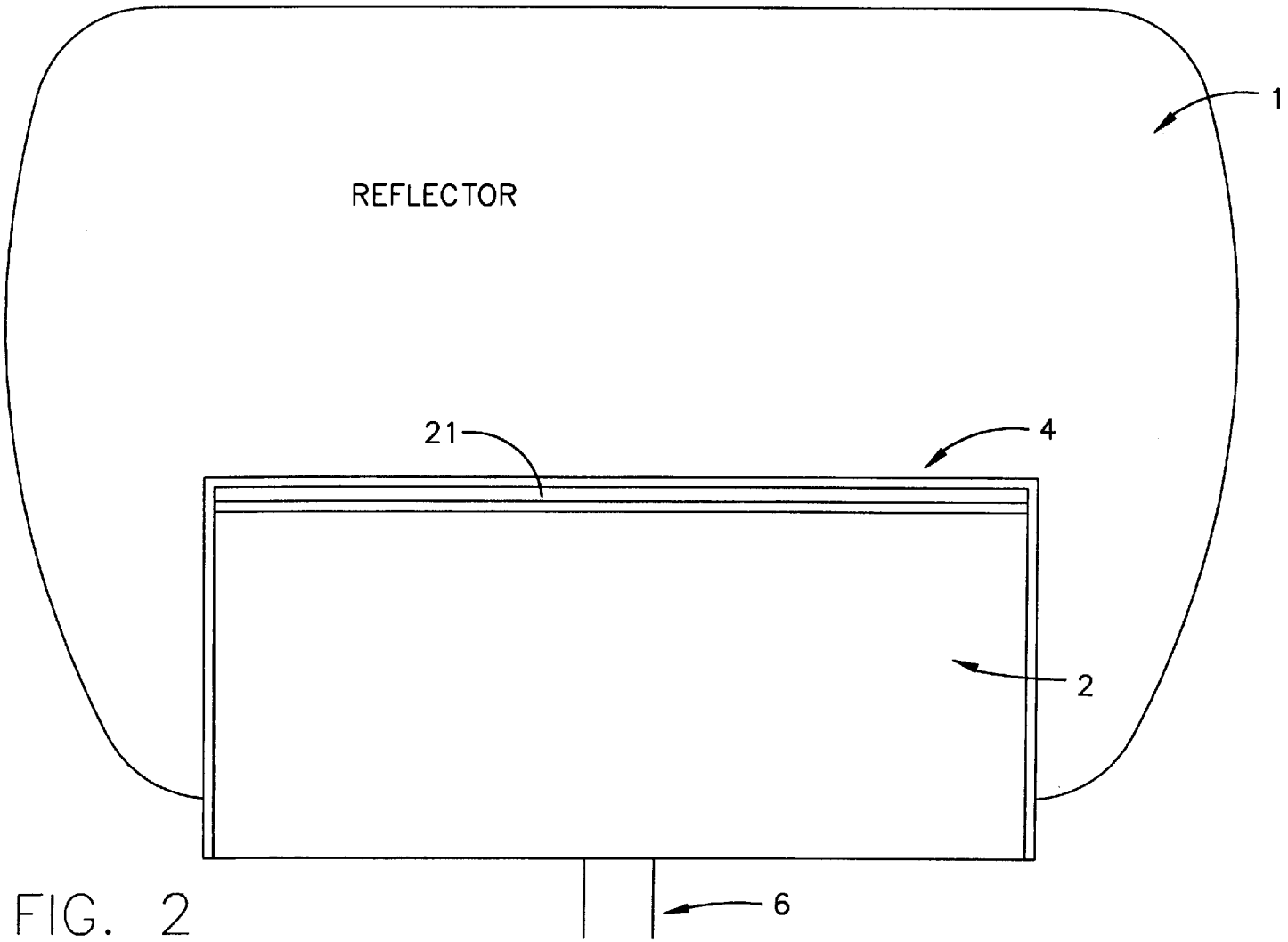
FIG. 2 is a front view of the FIG. 1 antenna system.
Figure 3:
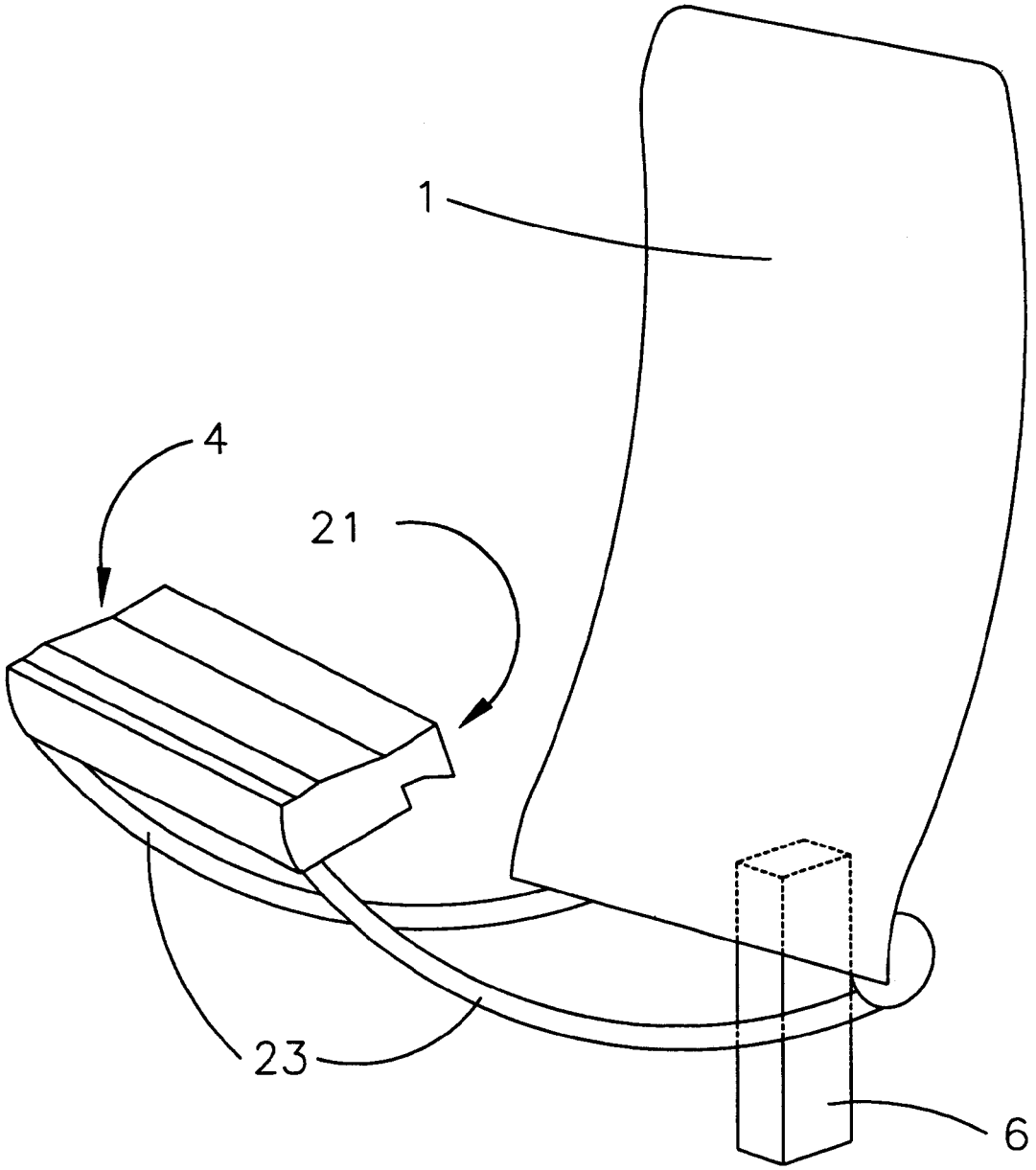
FIG. 3 is a perspective view of the FIGS. 1–2 antenna system.

Referring to FIGS. 1–3, the antenna system includes reflector member 1. Reflector 1 has a cylindrical parabolic shape, wherein the reflector has a parabolic shape in the vertical plane and a flat or planar shape in the z-axis. Thus, reflector 1 is not parabolic in both directions, but only one, in certain embodiments of this invention. Because reflector 1 is parabolic in the vertical plane as shown, the system has a long feed assembly along a focal line due to the non-parabolic design in the z-axis. This long or elongated feed assembly of the reflector 1 along the focal line allows orthogonal mode junction (OMJ) 4 to have an elongated, substantially horizontally aligned, feed area 21 as shown in FIGS. 2–3. In certain preferred embodiments, reflector 1 may be made of structural foam including a reflective metallic coating thereon. According to alternative embodiments of this invention, reflector 1 may be formed as a reflective surface of the waveguide 11.

The provision of reflector 1 in combination with dielectric lenses 3*a* and 3*b* allows the antenna system of certain embodiments of this invention to receive signals from satellites emitting either horizontally polarized signals or vertically polarized signals as will be discussed below. Horizontally and vertically polarized signals are orthogonal to one another as is known to those in the art. Furthermore, this invention in alternative embodiments may enable the user to receive signals from satellites emitting either left or right handed circularly polarized signals, or linearly polarized signals, as will be appreciated, as left and right handed circularly polarized signals are also orthogonal to one another.

The antenna system also includes first and second waveguides 10 and 11 which are collectively numbered 2. These two waveguides are aligned substantially parallel to one another, and includes two parallel conductive surfaces each spaced apart from one another (e.g. by about ⅜"). Waveguides 10 and 11 provide the radial TEM (transverse electric or electromagnetic wave) wave guide mode from corresponding lenses 3*a* and 3*b*, as they are both TEM mode radial guides. Each waveguide 10 and 11 includes two sections, one section located between OMJ 4 and the corresponding lens 3*a*, 3*b*, and another section disposed between the corresponding lens and LNB 5. In certain embodiments, each waveguide may be made of any suitable material (e.g. stainless steel) and having a reflective aluminum or copper metal coating (i.e. low loss surface). Waveguides 11 and 10 (collectively 2) allow microwaves from lenses 3*a* and 3*b* to focus on different output portions of LNB 5 corresponding to selectable different satellite locations. Two waveguides are needed because one is used to carry or convey each of the two orthogonal polarities.

Each dielectric lens 3*a*, 3*b* is identical to one another in certain embodiments of this invention. Lenses 3*a* and 3*b* are fed orthogonally, as one lens 3*a* facilitates one polarity (e.g. horizontal) while the other lens 3*b* facilitates an orthogonal polarity (e.g. vertical). In certain embodiments, each lens 3*a*, 3*b* may be made of crystalline polystyrene or alternatively of polyethylene.

Mount 6 supports parallel waveguides 10, 11, as well as lenses 3*a*, 3*b*, reflector 1, and junction 4. Antenna mount assembly enables elevational adjustment, azimuthal adjustment, and rotational adjustment of the reflector 1 and feed 21 about the Clark belt.

Unique orthogonal mode junction 4, having feed area 21, receives linear signals from reflector 1, and separates the horizontally polarized signals from the vertically polarized signals, and places or directs them in corresponding separate parallel plate TEM waveguides 10 and 11 in order to illuminate dielectric lenses 3*a* and 3*b*. In other words, satellite signals, from a plurality of different satellites, are received by reflector 1 and are reflected into feed 21 of orthogonal mode junction 4 in the form of microwave signals. Junction 4 divides out vertically polarized microwave signals from horizontally polarized microwave signals, and forwards one polarity signal into waveguide 10 and the other polarity signal into waveguide 11. Thus, one lens 3*a* is illuminated by the vertical polarization sense and the other lens 3*b* is illuminated by the horizontal polarization sense. An important feature of OMJ 4 is that the feedhorn has the ability to accommodate the focal line or cylindrical parabolic reflector 1 and is also able to feed first and second parallel plate TEM-mode waveguides 10, 11, and first and second dielectric lenses 3*a* and 3*b*. The parallel plate orthogonal mode in conjunction with lenses 3*a*, 3*b* and the parabolic reflector provided the advantages discussed herein.

From lenses 3*a* and 3*b*, the microwave signals propagate or travel down their respective waveguides 10 and 11 to multiple beam port low noise block converter (LNB) 5. LNB 5 includes printed circuit boards (PCBs) [shown in FIGS. 16–18] positioned within a housing. LNB 5 is responsible from selecting the specific satellite(s) of interest to the user and configuring the polarities of linear (horizontal and vertical) and circular (right and left hand of choice).

In certain embodiments of this invention, OMJ 4 may be made of extruded aluminum, or any other suitable material. Also, impedance matching steps 27 are provided withing the interior of OMJ 4 for impedance matching purposes (i.e. waveguide transformers).

FIG. 2 is a front view of the FIG. 1 antenna system. As shown in FIG. 2, feed 21 of OMJ 4 is elongated in design so as to correspond to a focal line of the reflector which is substantially parallel thereto. FIG. 3 is a perspective view of the FIGS. 1–2 system. Also illustrated in FIG. 3 are endcaps 23 located along the elongated and curved edges of the waveguides.

Figure 4:
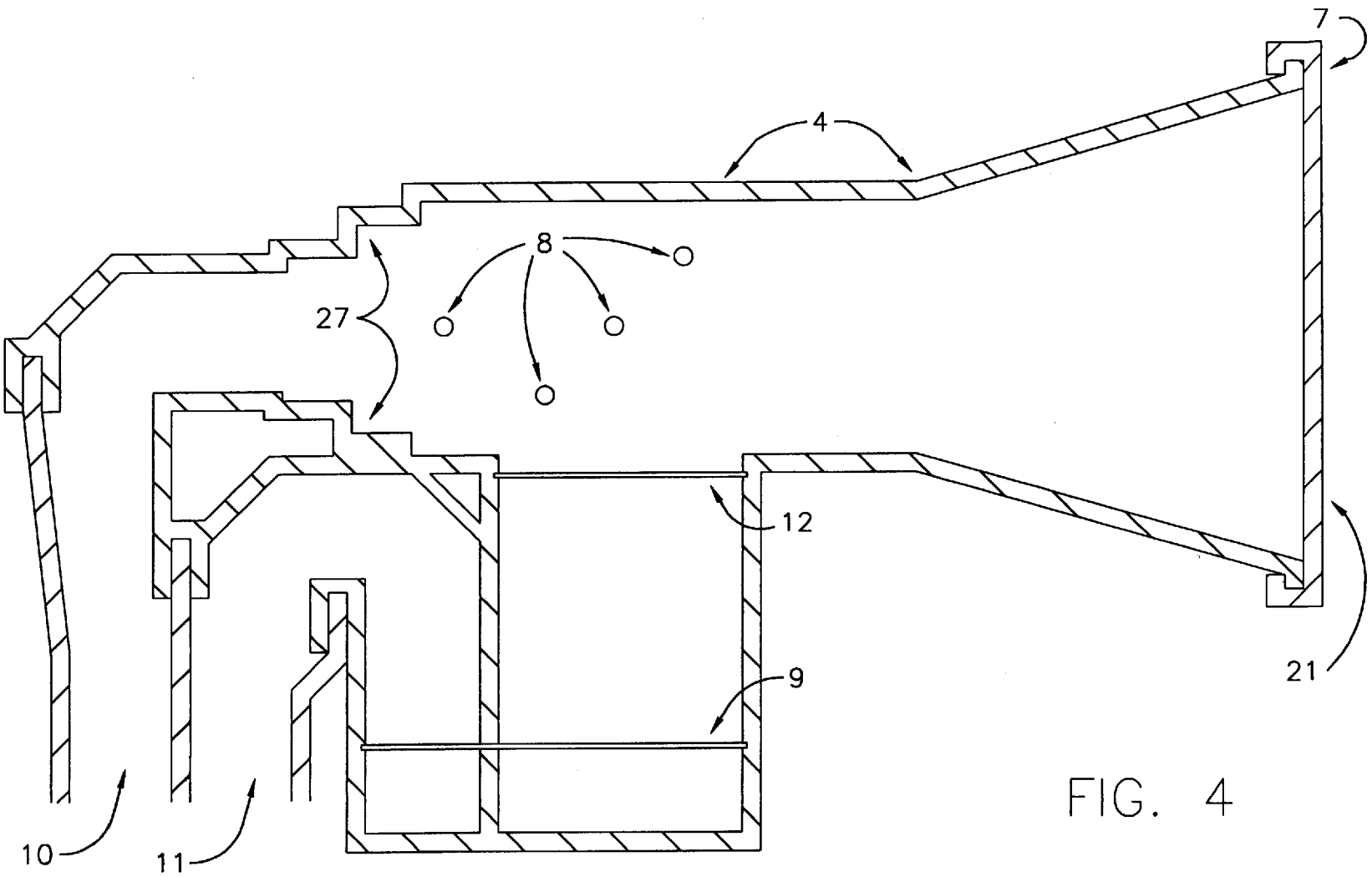
FIG. 4 is an enlarged side cross sectional view of the orthogonal mode junction (OMJ) member of the FIGS. 1–3 embodiment.
Figure 7:
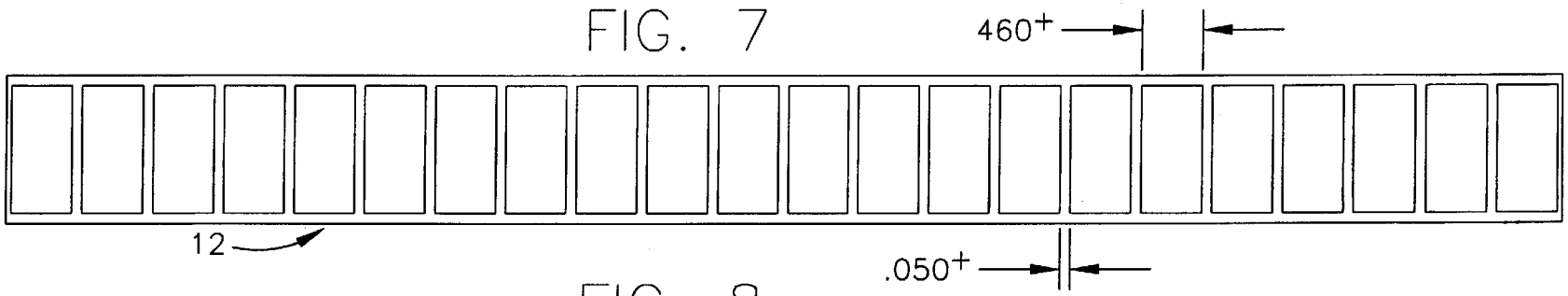
FIG. 7 is a top view of the isolating member of the FIGS. 4–6 orthogonal mode junction member, this member performing orthogonality selection in the junction.

FIG. 4 is an enlarged side cross sectional view of the orthogonal mode junction (OMJ) member 4 of the FIG. 1–3 embodiment. Elongated rods 8, provided in the OMJ, may be from about 0.040 to 0.060 inches in diameter (preferably in this embodiment about 0.050 inches in diameter). Isolating rods 8 are configured within the housing of OMJ 4 so as to isolate the horizontally polarized component of the received (or transmitted) signal that comes into feed 21 from waveguide 10 to waveguide 11. Meanwhile, isolating board 12 in OMJ 4 isolates the vertical component of the received (or transmitted) signal from waveguide 11 to waveguide 10. Isolator 12 in certain embodiments may be fabricated of 0.0050 (5 mil) inch thick beryllium copper (or plane copper) in order to perform its isolation function. FIG. 7 is a top view of isolator 12, illustrating the grid assembly responsible for sorting out the orthogonal signals with rods 8.

Figure 8:
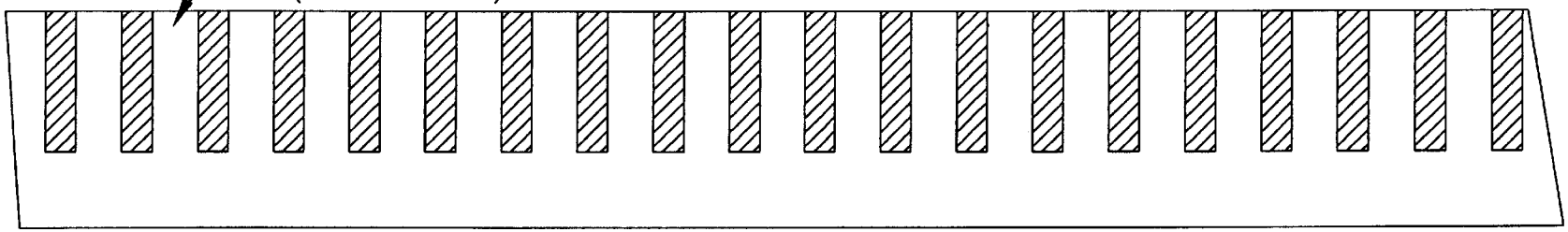
FIG. 8 is a bottom view of a printed circuit board (PCB) from the FIGS. 4–6 orthogonal mode junction member, this PCB transducing horizontal components of the received or transmitted signals into a TEM mode electromagnetic illumination of a parallel plate waveguide connected to the junction; and wherein the base board in FIG. 8 is shown in elevation form and the metal is shown in cross-section.
Figure 9:
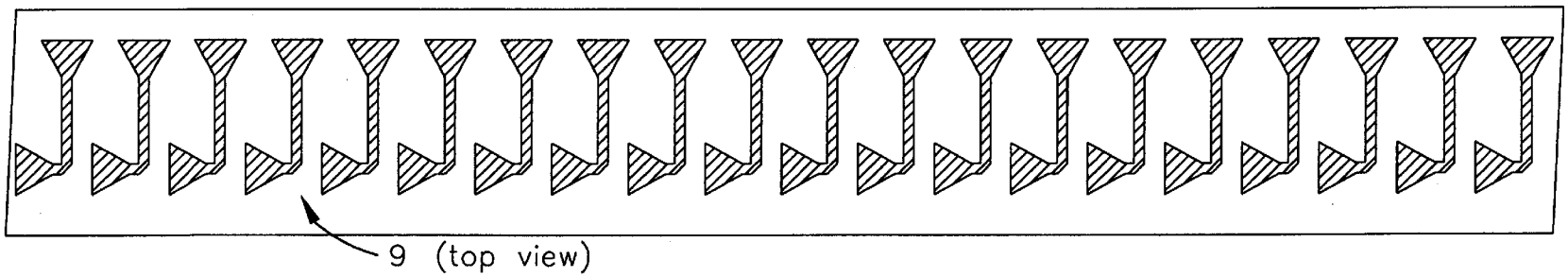
FIG. 9 is a top view of the FIG. 8 printed circuit board, with metal being shown in cross section and base board shown in an elevation manner.
Figures 10, 11, 12, 13:
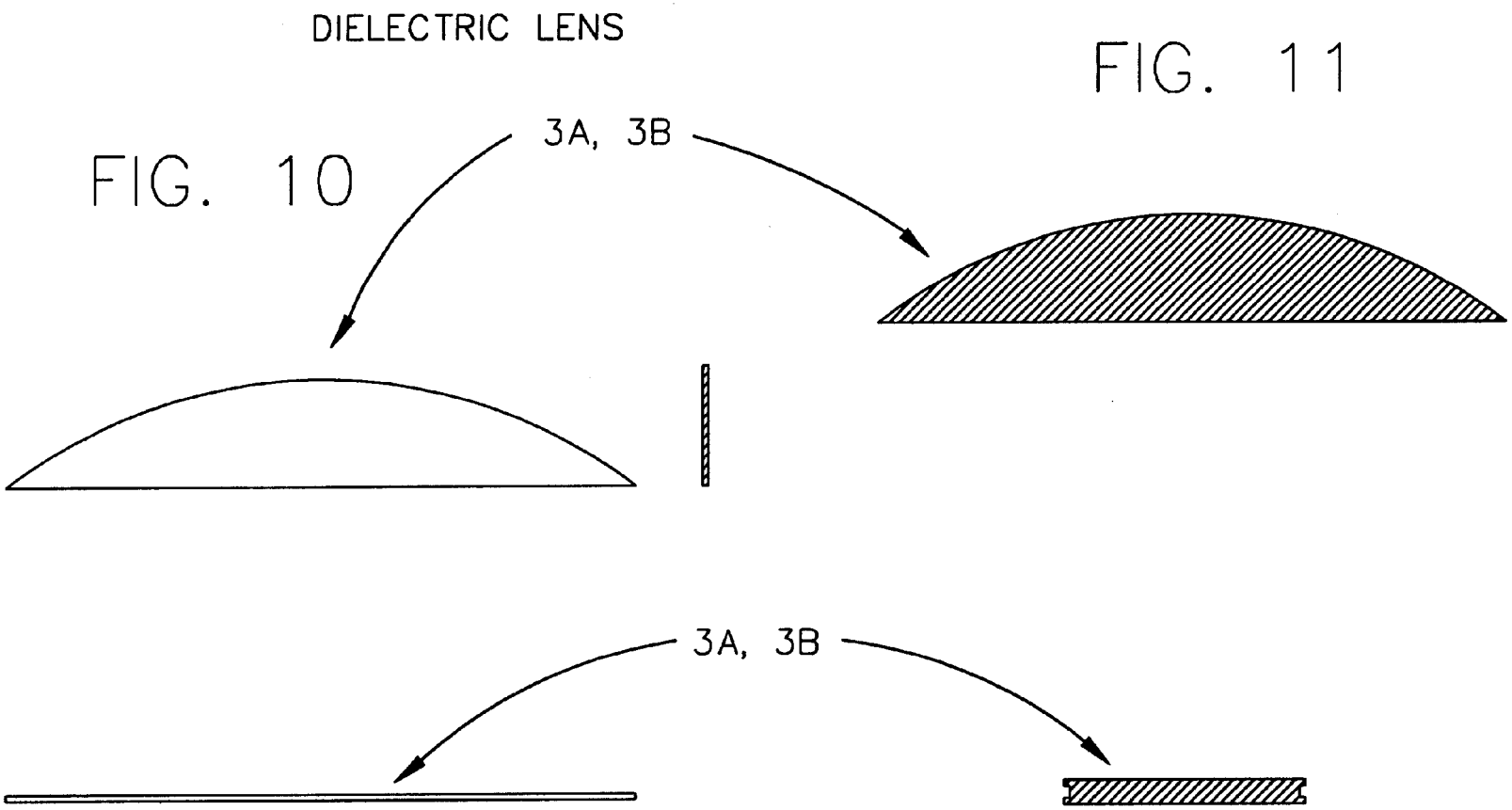
FIG. 10 is a schematic illustrating form and dimensions of a lens of the FIGS. 1–9 embodiment of this invention.
FIG. 11 is a cross sectional view of the FIG. 10 lens, along section line A—A.
FIG. 12 is an elevational view of the FIGS. 10–11 lens.
FIG. 13 is a cross sectional view of the FIGS. 10–12 lens, along section line B-B.

Transducer board 9, shown in FIG. 9 as part of OMJ 4, may be a printed circuit board (PCB) fabricated on 0.020 inch thick Teflon fiberglass in certain embodiments. Metal transducers on PCB 9 transduce the horizontal component of the received (or transmitted) signal into a TEM mode electromagnetic illumination of parallel plate waveguide 11. FIG. 8 is a bottom view of transducer board 9 while FIG. 9 is a top view of board 9, with the metallic transducers being shown in cross section.

OMJ 4 further includes radome 7 which has traditional radome characteristics such as protection, in order to accommodate the feed assembly.

Figure 5:
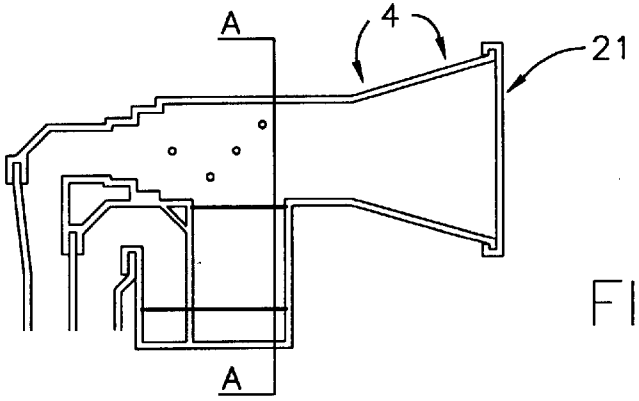
FIG. 5 is a side cross sectional view of the orthogonal mode junction of the FIGS. 1–4 embodiment.
Figure 6:
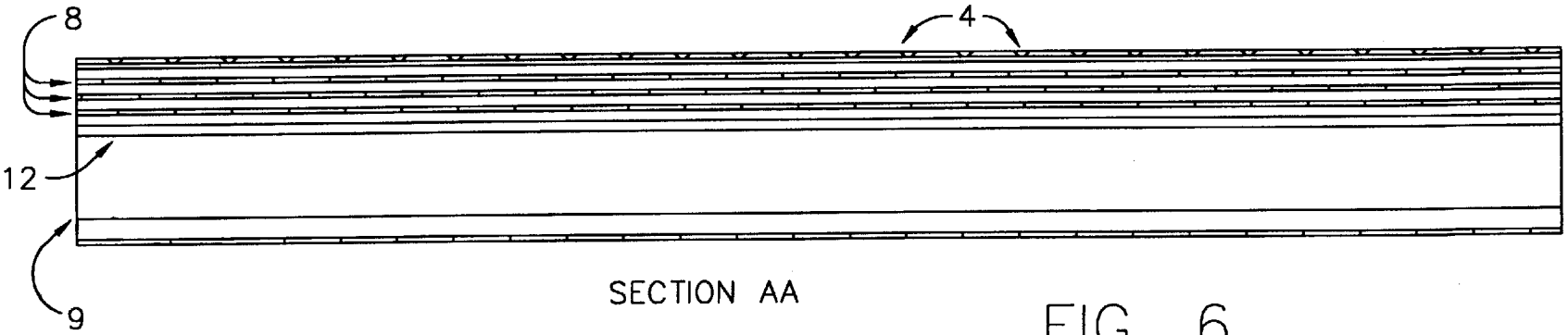
FIG. 6 is a cross sectionally view of the FIGS. 4–5 orthogonal mode junction member taken along section line AA in FIG. 5.

FIGS. 5 and 6 further illustrate OMJ 4, with FIG. 6 being a sectional view along section line AA. As shown, each of components 8, 9, and 12 are substantially parallel to one another, and are substantially elongated in design. Each of elements 8, 9, and 12 is substantially as long as feed 21 of the OMJ.

FIGS. 10–13 illustrate one of dielectric lenses 3*a* or 3*b* according to an embodiment of this invention. In certain preferred embodiments, both optical lenses are identical, but may be different in other alternative embodiments. One lens is provided for each orthogonal mode, e.g. one for vertical signals and one for horizontal signals. The lenses according to this invention can receive/transmit linear or circularly polarized signals simultaneously.

Figures 14, 15:
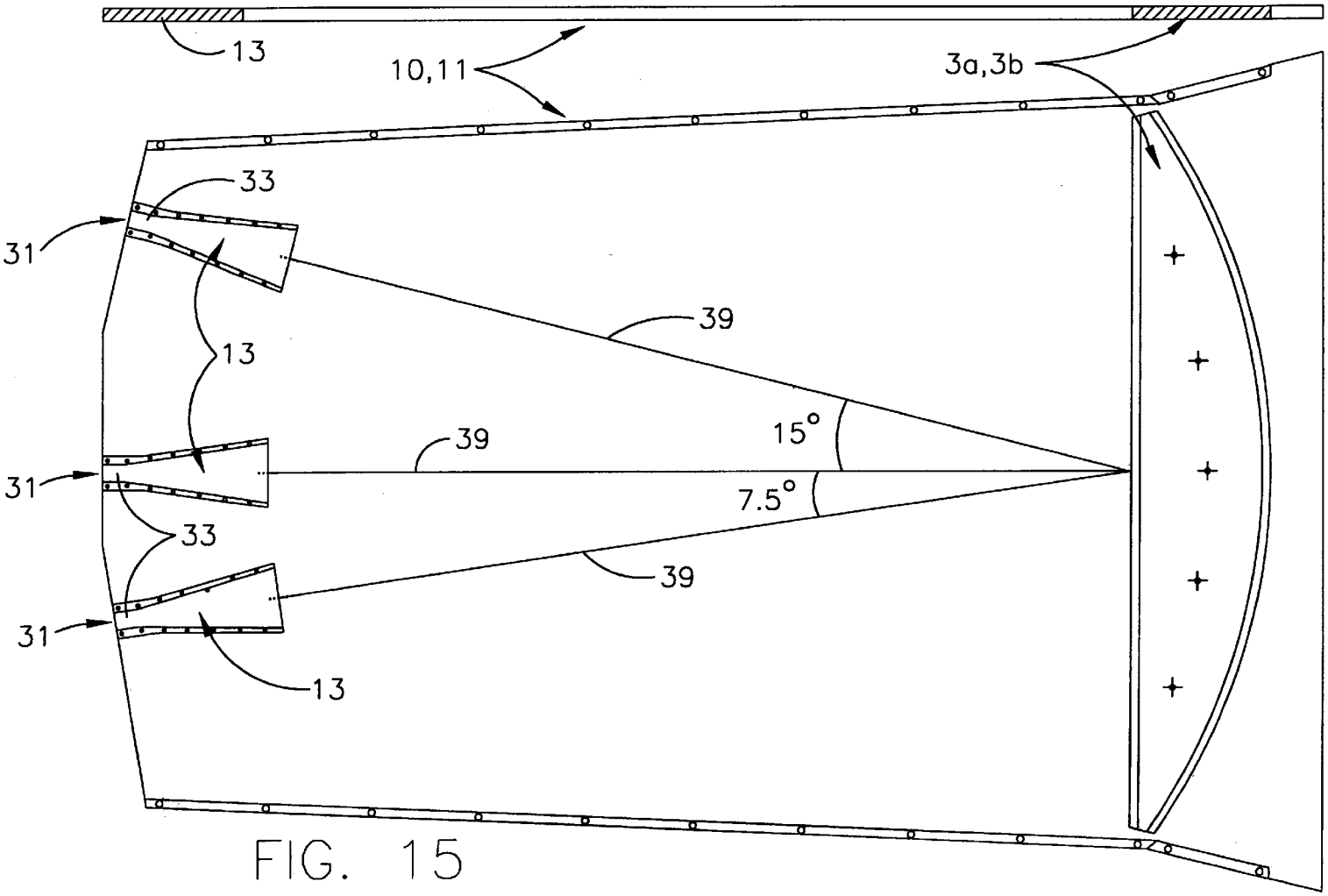
FIG. 14 is a side view of a waveguide of the FIG. 1 embodiment of this invention, the waveguide in this figure being shown in "flattened out" form for purposes of illustration (each of the waveguides are not "flat" but are instead curved as shown in FIG. 1, in operative embodiments of this invention).
FIG. 15 is a top view of the FIG. 14 waveguide.

FIGS. 14–15 illustrate sectorial feedhorns 13 within one of waveguides 10, 11. It is noted that while FIG. 14 illustrates the waveguide as being "flat" for purposes of simplicity, it really is not flat in practice [note the curved banana-shaped configuration of each waveguide 10, 11 in FIG. 1]. Feedhorns 13 are positioned within the waveguides so as to accommodate the orbital locations of the satellites of interest within the geostationary Clark belt. These focused horns 13 receive the focused signals from the corresponding dielectric lens 3*a*, 3*b* of the polarity of the corresponding lens. The configurations, quantity or number, and position of feedhorns 13 correspond to the number of satellites to be accessed or used. The outputs 31 of the feedhorns are coupled to the LNB circuit boards shown in FIGS. 16–18, through rectangular waveguides 33 of the WR-75 type.

Still referring to FIG. 15, from left to right, the microwave signals coming out of the lens 3*a*, 3*b* propagate down the waveguide toward and into feedhorns 13. Lines 39 illustrate the scanning angle, provided by each feedhorn, of the different satellites (3 in this embodiment) to be accessed or used. As the positions of the feedhorns dictate which satellites are to be used, it is noted that the is a 15 degree difference in the location of the satellite corresponding to the uppermost feedhorn 33 and the middle feedhorn 33, while there is only a 7.5 degree difference in the position of the satellite corresponding to the middle feedhorn and the lowermost feedhorn 33. Thus, sectorial feedhorns 33 accommodate the satellites of interest. It is also noted that feedhorns 13 as shown in FIGS. 14–15 are sandwiched between a pair of upper and lower plates that are not shown.

Figure 16:
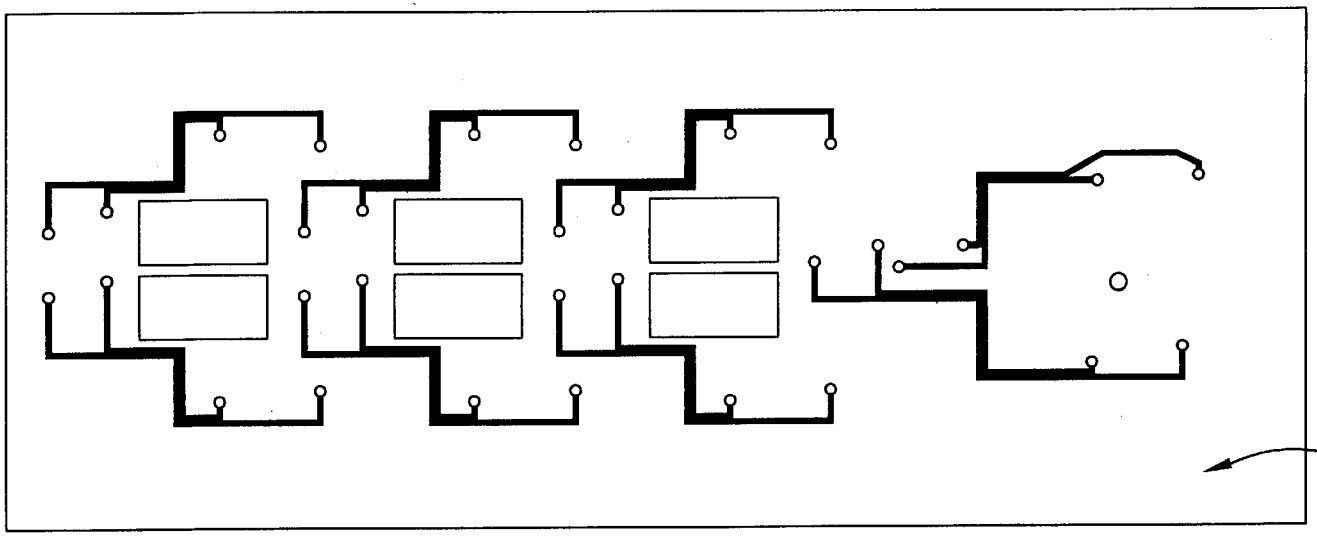
FIG. 16 is a bottom view of the RF PCB section of the three port low noise block converter (LNB) of the FIG. 1 embodiment of this invention.
Figure 17:
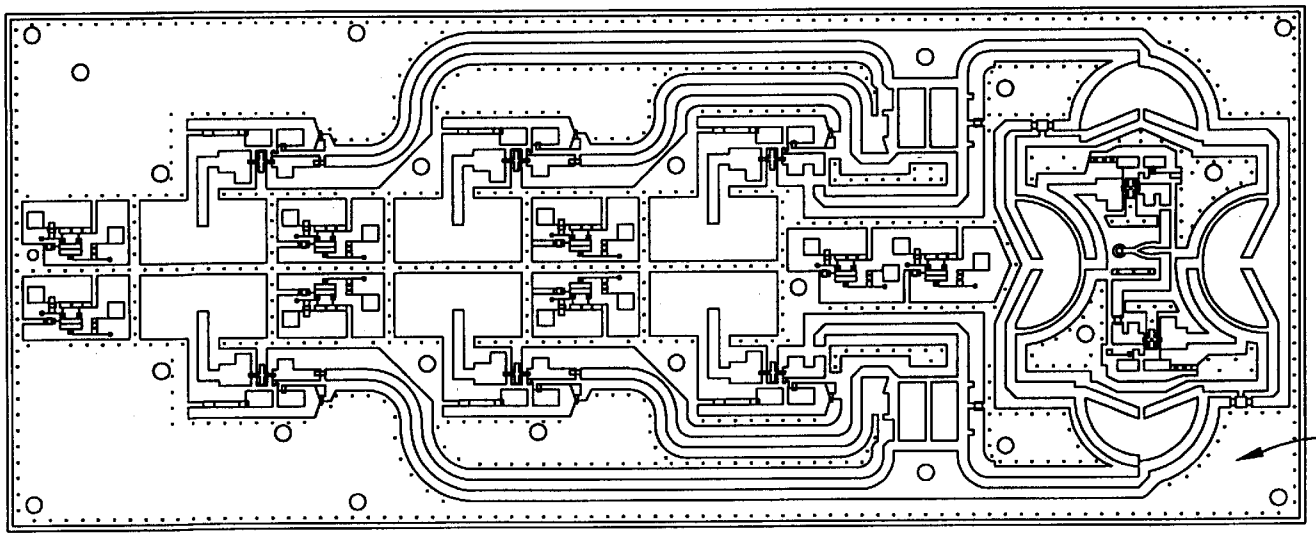
FIG. 17 is a top view of the RF PCB section of FIG. 16.
Figure 18:
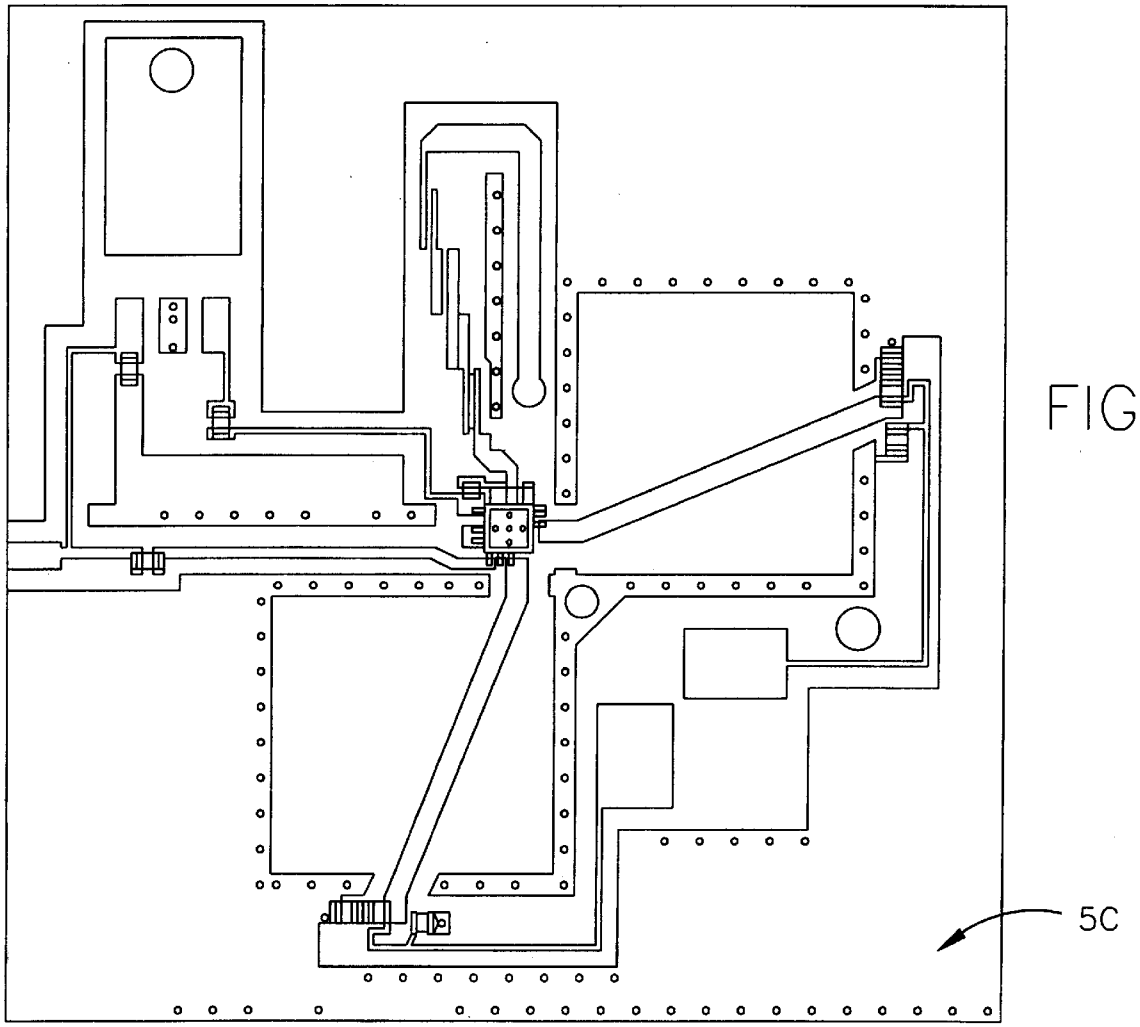
FIG. 18 is a top view of another PCB within the housing of the LNB in the FIG. 1 embodiment.

The LNB 5 housing contains the two circuit boards shown in FIGS. 16–18. These boards perform the following functions: low noise RF amplification, down converts from RF to IF, selects IF frequency and number of IFs, selects satellites of interest as dictated by the user, selects polarity (linear (hor. or vert.) or circular) of interest, switch matrix for multiple outputs or multiple IFs, IF amplification, converts WR-75 to circular board strip-line waveguide, compensates for polarity skew in various geographic locations, and may be an antenna to set-top-box interface.

FIGS. 19–22 illustrate how lenses 3*a*, 3*b* may be utilized to access different types of signals according to certain embodiments of this invention. For a more detailed description, see U.S. Pat. No. 5,495,258, the disclosure of which is incorporated herein by reference.

While in preferred embodiments, each lense deals with a linearly polarized signal (either hor. or vert.), in certain embodiments, circularly polarized signals may also be accessed and utilized. In accordance with the above described lens designs, the lenses in combination of the multiple beam antenna systems of this invention allow the systems to select a single beam or a group of beams for reception (i.e. home satellite television viewing). Due to the design of the antenna array and matrix block, right-handed circularly polarized satellite signals, left-handed circularly polarized satellite signals, and linearly polarized satellite signals within the scanned field of view may be accessed either individually or in groups. Thus, either a single or a plurality of such satellite signals may be simultaneously received and accessed (e.g. for viewing, etc.).

Figure 19:
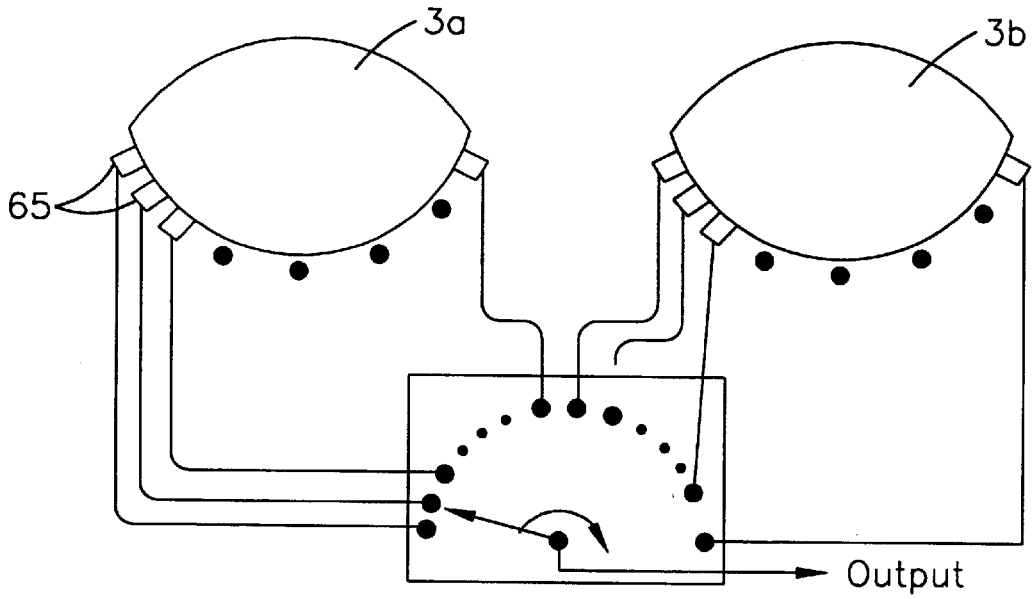
FIGS. 19–22 are schematic diagrams illustrating different scenarios of the lenses being manipulated by the output block in order to view particular satellites.

FIG. 19 illustrates the case where the user manipulates satellite selection matrix to simply pick up the signal from a particular satellite which is transmitting a horizontal signal. In such a case, the path length in lens 3*a* is adjusted so as to tap into the signal of the desired satellite.

Figure 20:
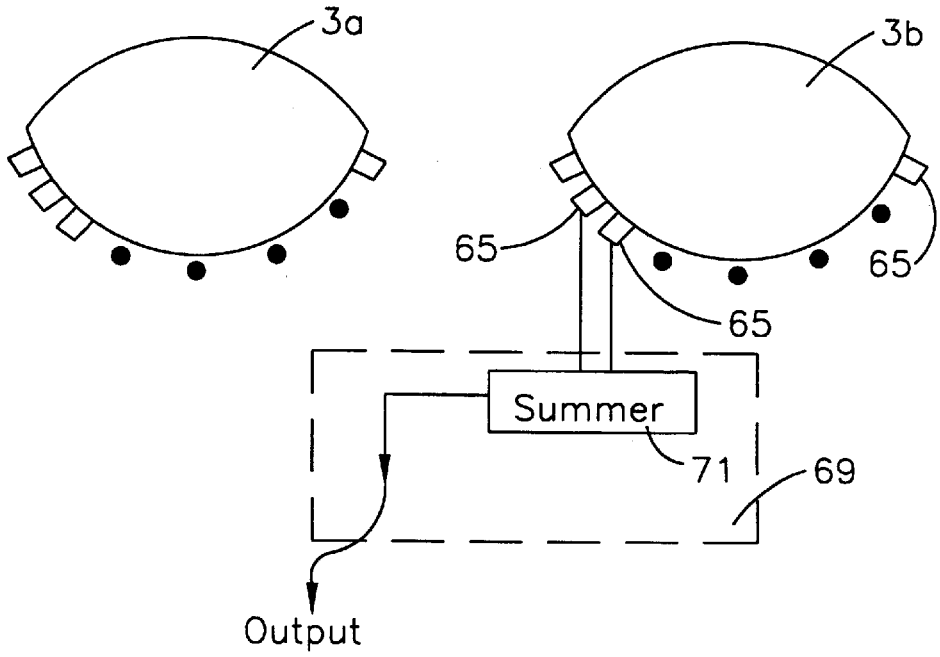

FIG. 20 illustrates the case where a plurality of received outputs from lens 3*b* are summed or combined in amplitude and phase. The signals from two adjacent outputs 65 are combined at summer 71 so as to split the beams from the adjacent output ports 65. Thus, if the viewer wishes to view a satellite disposed angularly between adjacent output ports 65, output block 69 takes the output from the adjacent ports 65 and sums them at summer 71 thereby "splitting" the beam and receiving the desired satellite signal. It is noted that a small loss of power may occur when signals from adjacent ports 65 are summed in this manner.

Figure 21:
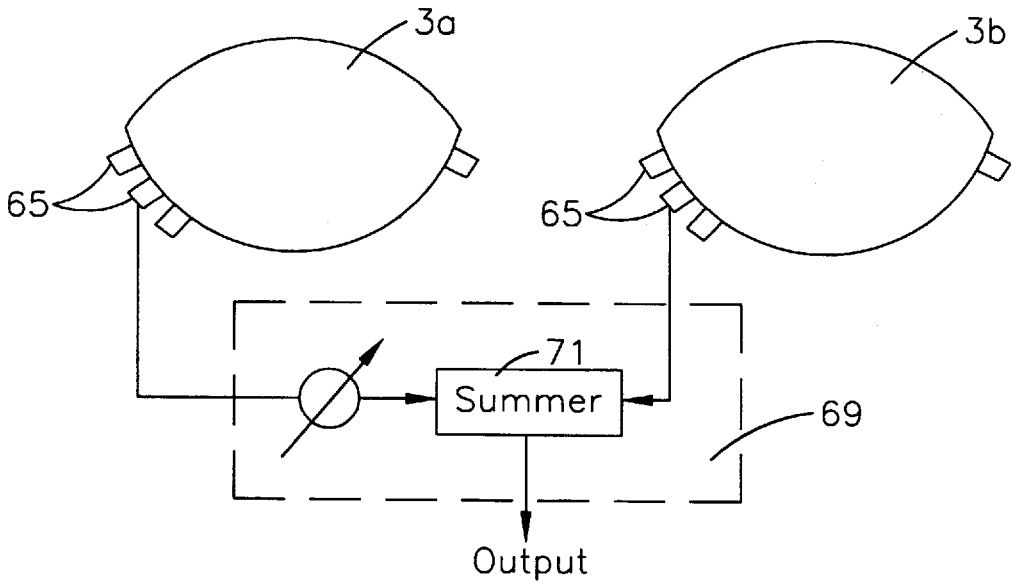

FIG. 21 illustrates the case where outputs 65 from both lenses are tapped (in a circular embodiment as described in the '258 patent) so as to result in the receiving of a signal from a satellite having circular (or linear) polarization.

Figure 22:
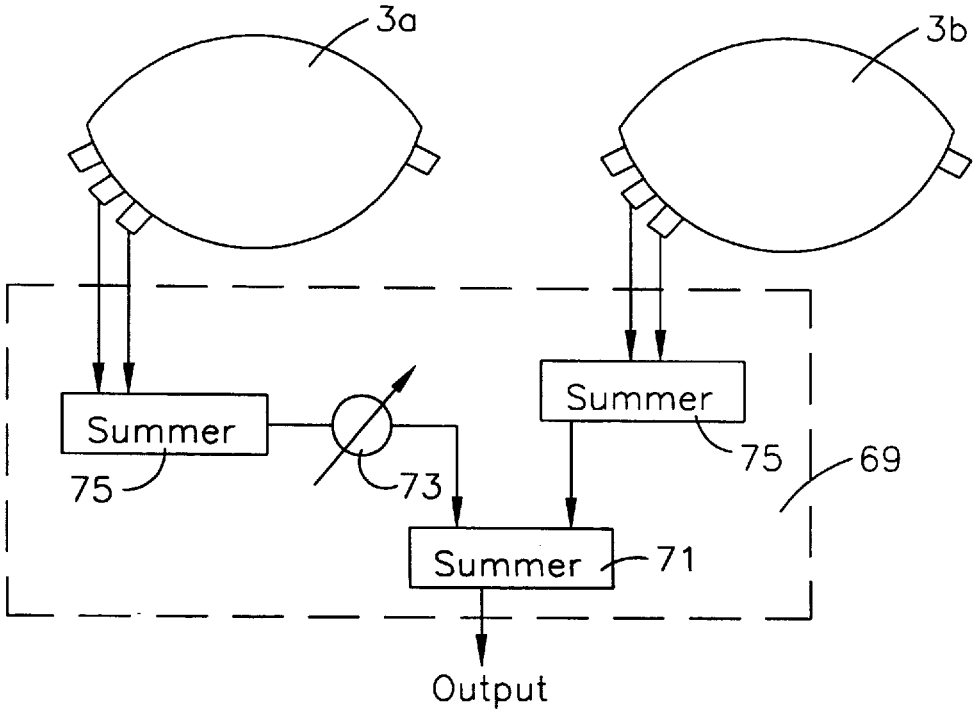

FIG. 22 illustrates the case where it is desired to access a satellite disposed between the beams of adjacent ports 65 wherein the satellite emits a signal having circular (or linear) polarization. Adjacent ports 65 are accessed in each of lenses and are summed accordingly at summers 75. Thereafter, phase shifter 73 adjusts the phase of the signal from one lens and the signals from the lenses are combined at summer 71 thereafter outputting a signal from output block 69 indicative of the received linearly polarized signal.

Once given the above disclosure, therefore, various other modifications, features or improvements will become apparent to the skilled artisan. Such other features, modifications, and improvements are thus considered a part of this invention, the scope of which is to be determined by the following claims. For example, the above-discussed multiple beam antenna system can receive singularly or simultaneously any polarity (circular or linear) from a single or multiple number of satellites, from a single or multiple number of beams, knowing that co-located satellites utilize frequency and/or polarization diversity.

We claim:

1. A multiple beam antenna system for simultaneously receiving signals of different polarity that are orthogonal to one another, the system comprising:

means for receiving each of first and second polarized signals that are orthogonal to one another;

means for simultaneously receiving said first and second signals; and a parabolic reflective member communicatively associated with first and second lenses, said reflective member and said first and second lenses for forwarding said first signal of a first polarity into a first waveguide and said second signal of a second polarity into a second waveguide.

2. The antenna system of claim 1, wherein said antenna system is designed to receive satellite television signals from about 10.7–13 GHz, and wherein said system can simultaneously receive horizontally polarized signals and vertically polarized signals, and wherein said first signal is horizontally polarized and said second signal is vertically polarized.

3. The system of claim 1, further including means for simultaneously receiving both circularly polarized signals and linearly polarized signals and outputting said simultaneously received signals to a user.

4. The system of claim 1, further including means for simultaneously receiving multiple beams and multiple polarities of the circular and linear type.

5. A multiple beam antenna system comprising:

a reflective member that is substantially parabolic in at least one dimension;

a junction for receiving microwave signals from the reflective member;

first and second dielectric lenses in communication with said junction member;

first and second waveguides in communication with said first and second lenses, respectively;

wherein said junction receives microwave energy including a first signal having a first polarity and a second signal having a second polarity from said reflective member;

wherein said junction causes said first signal having said first polarity to be forwarded to said first lens and said second signal having said second polarity to be forwarded to said second lens, wherein said first and second polarities are different; and wherein a signal resulting from said signal of said first polarity exits said first lens and proceeds down said first waveguide, and a signal resulting from said signal of said second polarity exits said second lens and proceeds down said second waveguide so that a user can receive signals of different polarity from different satellites.

6. The antenna system of claim 5, wherein said first and second polarities are substantially orthogonal to one another.

7. The antenna system of claim 5, wherein said first polarity is substantially horizontal and said second polarity is substantially vertical, and wherein said first and second waveguides are substantially parallel to one another along at least one portion thereof.

8. The antenna system of claim 5, wherein said reflective member is substantially parabolic in shape in the vertical plane and is substantially flat in the z-axis.

9. The antenna system of claim 5 wherein said first and second waveguides are substantially parallel to one another throughout their entire respective lengths, and wherein each of said waveguides is bent or angled so that first and second sections of said waveguides extend in different directions, and wherein said different directions are different from one another by an angles of from about 45 to 150 degrees.

10. The antenna system of claim 5 wherein said junction includes an elongated feed area that receives signals from said reflective member.

11. The antenna system of claim 10, wherein said junction includes impedance matching steps defined by at least one wall thereof.

12. The antenna system of claim 10, wherein said junction includes a plurality of elongated members extending across a signal path that function to separate signals of different polarity from one another.

13. The antenna system of claim 12, wherein said elongated members are rods.

14. The antenna system of claim 12, wherein said junction includes a transducer for transducing a particular polarity component of a received signal into a TEM mode electromagnetic illumination of one of said waveguides.

15. The antenna system of claim 14, wherein said transducer includes a plurality of metallic transducers and said junction is made of an extruded metal.

16. The antenna system of claim 10, wherein said junction is in communication with a pair of waveguides that allow said junction to communicate with said first and second lenses.

* * * * *